United States Patent [19]

Dummer

[11] 4,304,337

[45] Dec. 8, 1981

[54] MARINE CRANE LIFTING CONTROL

[75] Inventor: Robert E. Dummer, Milwaukee, Wis.

[73] Assignee: Bucyrus-Erie Company, South Milwaukee, Wis.

[21] Appl. No.: 154,510

[22] Filed: May 29, 1980

[51] Int. Cl.[3] ..... B66D 1/50

[52] U.S. Cl. ..... 212/191; 414/139

[58] Field of Search ..... 212/190, 191; 254/274, 254/277, 361, 900; 414/137, 138, 139

[56] References Cited

U.S. PATENT DOCUMENTS

| | | | |
|---|---|---|---|
| 3,753,552 | 8/1973 | Barron | 254/900 X |
| 3,799,505 | 3/1974 | Duncan | 254/274 X |
| 4,132,387 | 1/1979 | Somerville et al. | 254/361 X |
| 4,166,545 | 9/1979 | Martinussen et al. | 414/139 |
| 4,180,171 | 12/1979 | Cunningham et al. | 212/191 X |
| 4,180,362 | 12/1979 | Stair | 414/139 |

FOREIGN PATENT DOCUMENTS

| | | |
|---|---|---|
| 1562745 | 5/1977 | United Kingdom . |
| 2006151 | 5/1979 | United Kingdom . |

OTHER PUBLICATIONS

"Cargo Handling Unit in Force 8 Seas", *Ocean Industry,* Jan. 1980, p. 74.

"Crane Control a Must in Restless North Sea", *Offshore,* Feb. 1977, pp. 72–76.

"Towards Safer Offshore Lifting", *Cranes Today,* Jun. 1977, pp. 33, 36, 37.

"Engineering", *Crane Digest,* Apr. 1978, pp. 1, 2.

"Crestpicker Wave Motion Compensator for Cranes", Offshore-Hydro Limited Sales Literature, 4 pages.

"Heavy Weather Offshore Lifting", *Cranes Today,* Apr. 1977, pp. 31, 32.

"Hook Block Heave Compensator", Sedame Sales Literature, 6 pages.

"Motion Compensator Handles Cargo", *Ocean Industry,* Jan. 1979, p. 78.

"Reducing the Hazards of Offshore Lifting in Heavy Seas", *Cranes Today,* Jan. 1979, pp. 33, 34.

"Snatch Load Absorber", *Cranes Today,* Apr. 1979, pp. 52, 53.

*Primary Examiner*—James L. Rowland

*Attorney, Agent, or Firm*—Quarles & Brady

[57] ABSTRACT

A marine crane includes a high speed winch having a hydraulic heave compensating system that automatically controls the crane winch to compensate for the vertical movement of a load during offloading operations. The heave compensating system includes a reversing valve for overriding manual control and for directing control pressure to stroke the pump of a hydrostatic winch drive into its raise mode of operation, and a compensating valve that regulates the displacement of the pump permitting it to develop and maintain only a predetermined pressure in the high pressure main fluid line. The heave compensating system preferably includes a lift control system for automatically hoisting a heaving load only at or near the crest or trough of a wave.

9 Claims, 6 Drawing Figures

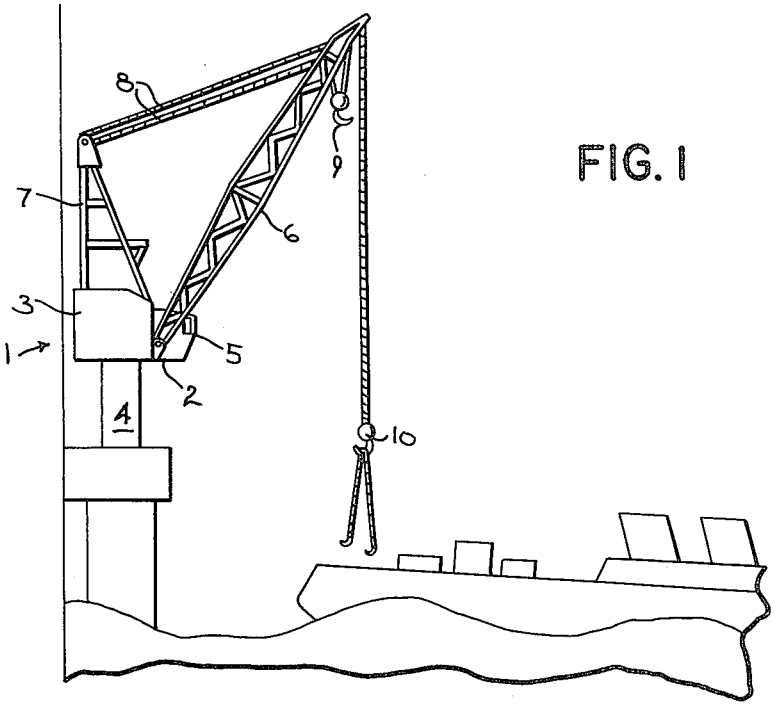
FIG. 1
FIG. 6
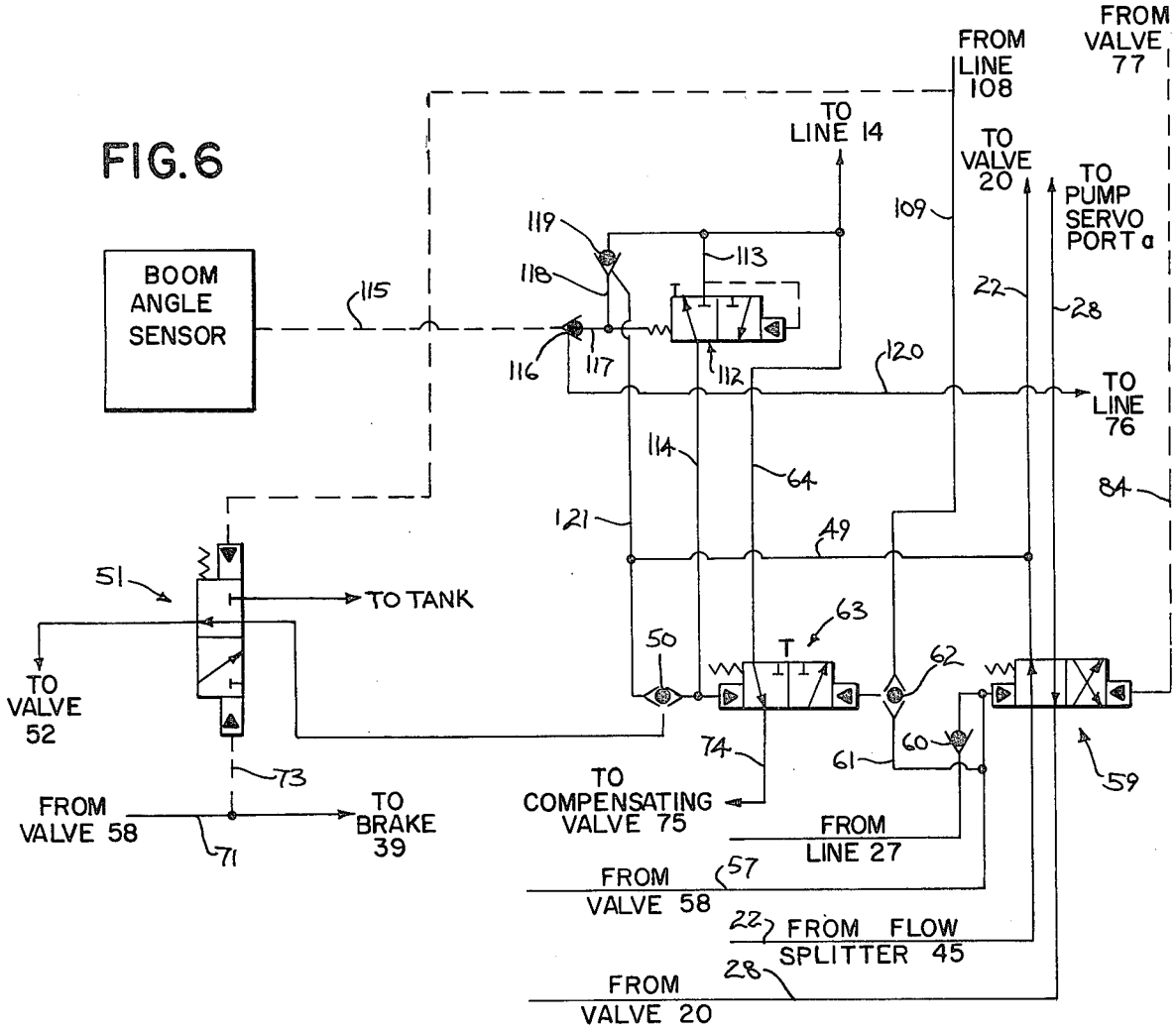

MARINE CRANE LIFTING CONTROL

BACKGROUND OF THE INVENTION

This invention relates to cranes, and more particularly, to a marine crane incorporating a high speed winch having a hydraulic heave compensating system together with an automatic lift control system, all to minimize dynamic shock loads imposed on the crane during offloading operations.

During the offloading of cargo from a supply ship, marine cranes can become subjected to unusually large, dynamic shock loads as the ship rises and falls in response to crests and troughs of waves. For example, if a lift occurs when the ship and cargo are moving downwardly into the trough of a wave, the dynamic shock load experienced by the crane can be five times or more greater than the normal static load imposed on the crane. Dynamic shock loads may also be imposed on the crane prior to a lift if its hoist rope is caused alternately to slacken and tighten in response to ship movement. An overload creating severe stresses can also develop if the cargo catches on ship rails or other protrusions of the ship superstructure during a lift.

The occurrence of dynamic shock loads during offloading is accentuated by the difficult operating conditions encountered by the crane operator. The operator is generally located in a cab on a pedestal supported high above the ship and must look nearly vertically downwards to see the deck of the ship. Nevertheless, the operator must maintain the crane hook close to the heaving deck of the ship while slings are attached to the load, then take up the slack in the slings as the deck rises, and finally hoist the load at the proper time, preferably close to a crest. Simultaneously, the operator must maintain luff and slew control to keep the hoist rope vertically positioned above the load so that a dangerous pendulum motion does not develop upon hoisting. Under these circumstances it is extremely difficult for the crane operator to judge the rise and fall of the ship and decide the correct moment to lift a load from the heaving deck.

A crane lifting a load on land experiences shock at the moment of lift, and such cranes may be properly designed to cope with these impacts. In contrast, however, the shock loading imposed upon marine cranes is unpredictable and dynamic and may lead to overload situations and eventually to stress failures. It is thus desirable to have an arrangement that reduces the dynamic shock loading imposed upon marine cranes. This would minimize the possibility of the crane toppling from its mountings, damage to the ship, crane, or its load, and injury to personnel.

The prior art has disclosed various arrangements for reducing the dynamic shock loads imposed upon marine cranes. In some of these arrangements, a device such as a shock absorber, pulley nest, or auxiliary winch is suspended from the crane hook to compensate for the heaving deck. See for example, U.K. Patent Application No. 2,006,151A published on May 2, 1979, and an article entitled "Motion Compensator Handles Cargo," published in Ocean Industry, January, 1979, at page 78. These types of devices, however, are fairly large, heavy and cumbersome structures and as a result reduce the lifting capacity and maneuverability of the crane.

Another type of arrangement for reducing dynamic shock impacts on marine cranes involves the use of a dual system of ropes. See for example, U.S. Pat. Nos. 4,180,171, 4,132,387 and 3,753,552. In these arrangements, one rope is used for hoisting and a second rope is attached to the ship or load. The second rope senses the motion of the ship and through a control mechanism compensates for the heave of the ship by keeping the hoisting rope in constant tension. These systems, however, generally use electronic controls, and if there is a general power outage on the platform the electronic controls may become inoperative. This problem may also occur with control systems that use microprocessors to determine the optimum time for lifting the load. Also, with a dual rope arrangement the ropes may easily become tangled as the ship rolls and pitches.

In still another type of arrangement, see for example, U.S. Pat. No. 3,799,505, the hoist rope extends from its hoist winch over the boom point and down around a sheave attached to the hook, and then back up around the boom point to a compensator winch which is separate from the hoist winch. The compensator winch operates to provide constant tension on the hoist rope. However, in these types of systems, the maximum hoist line speed generally cannot keep up with the velocities of heave on waves having large amplitudes. As a result, slack rope may develop during an upward heave. If this condition persists at the crest of a wave, the compensator winch will still be taking in rope when the load falls away. The result is a shock impact which may be quite severe.

Various other arrangements have also been utilized such as hydraulic rams, as described in U.K. Patent Application No. 2,023,530A published on Jan. 3, 1980, and separate winch arrangements on the crane and supply ship, as described in U.S. Pat. No. 4,180,362. However, none of these arrangements are entirely satisfactory, and the present invention has been developed to provide a high speed winch having a hydraulic wave motion compensating system together with an automatic lift control system.

SUMMARY OF THE INVENTION

The present invention relates to a hoist control system that reduces the dynamic shock impacts imposed upon a marine crane during offloading operations, and more specifically resides in a heave compensating system that automatically controls the crane winch to compensate for the vertical movement of a load on a ship's deck. The heave compensating system is an all-hydraulic system that includes a valve for overriding manual control and for directing control pressure to stroke the pump of a hydrostatic winch drive into its raise mode of operation, and a control circuit that regulates the displacement of the pump permitting it to develop and maintain only a predetermined pressure in the high pressure line.

The present invention may be incorporated with various hoist controls for cranes, but the invention contemplates a specific arrangement particularly suited for marine cranes having a pair of variable displacement hydraulic motors adapted to drive a winch, a variable displacement hydraulic pump for providing fluid to the motors through opposite main fluid lines, and a manually operated control valve providing control pressure through a pair of control lines to regulate the displacement of the pump.

In its preferred form, the heave compensating system includes a reversing valve having one position for permitting manual hoist control by directing control pressure to the control valve, and having a second position for overriding manual hoist control by isolating the control valve from control pressure and directing control pressure through one of the control lines to stroke the pump out of its neutral position to pump fluid into the raise side of the main fluid line to the motors. The compensating system also includes a manually operated compensator selection valve for applying control pressure to the reversing valve to shift the reversing valve between its alternative valve positions, and a compensating valve connected between the raise side main fluid line and the other control line. The compensating valve is shiftable to admit pressure from the raise side main fluid line to the other control line to regulate the displacement of the pump so that the pump develops only a predetermined pressure in the raise side main fluid line. As a result, a relatively constant tension is applied to the hoist rope as the load rises and falls with a wave.

The heave compensating system preferably includes a lift control system for automatically hoisting the heaving load at its optimum point of lift-off to minimize the impact load imposed on the crane, and at high speed to insure the load is rapidly hauled clear of the ship's deck. The lift control system includes a normally closed, manually operated lift selection valve having a second open position for directing control pressure to stroke the motors to maximum displacement and isolate the compensator valve so that the heave compensating system becomes inoperative. The lift system also includes a winch tachometer hydraulic circuit wherein flow is proportional to the speed of the heaving load and which includes a flow control for establishing a pressure differential indicative of the speed of the heaving load. The circuit also includes a two-position pressure sensing valve between the second control valve and the motors. The sensing valve has opposite pilot lines for sensing the pressure differential across the flow control. The sensing valve has a normally closed position for isolating the motors from control pressure when the pressure differential is greater than a predetermined limit, indicating that the speed of the load is too great for lifting, and a second open position for admitting control pressure to the motors when the pressure differential is less than the predetermined limit, indicating that the speed of the load is sufficiently slow to permit its lift-off from the ship. As a result, when the heaving load reaches the crest of a wave or the trough of a wave so that its velocity is near zero, the lift system will automatically hoist the load clear of the ship's deck.

The hoist control may also include an overload system for sensing an overload on the hoist rope and deactivating the automatic lift system, as well as a load sampling sytsem that prevents the dropping of a load already attached to the crane hook upon the accidental actuation of the heave compensating system. The load sampling system senses the initial load imposed upon the hoist rope and prevents the activation of the heave compensating system if the load is greater than a predetermined limit.

It is a general object of the invention to provide a hoist control system which minimizes the dynamic shock loading of marine cranes.

It is another object of the invention to provide a hoist control system that can readily be incorporated in standard marine cranes.

It is still another object of the invention to provide a hoist control system which does not reduce the lifting capacity or maneuverability of a marine crane.

It is yet another object of the invention to provide a hoist control system which utilizes a high speed winch that provides a line speed which is greater than the heave velocities of waves which develop under normal offloading conditions.

Another object of the invention is to provide an all-hydraulic hoist control system.

Another object of the invention is to provide a hoist control system that automatically maintains a predetermined tension on the hoist rope as the load rises and falls with the ship's deck and an automatic lift system that initiates a lift at the optimum time.

Another object of the invention is to provide a hoist control system that guards against the dropping of a load if the heave compensating system should accidentally be activated with a load already attached to the crane hook.

Another object of the invention is to provide a hoist control system that automatically shifts from the lift system back into the heave compensating system should an overload condition develop.

The foregoing and other objects and advantages of the invention will appear from the following description. In the description, reference is made to the accompanying drawings which form a part hereof, and in which there is shown by way of illustration and not of limitation a preferred embodiment of the invention. Such embodiment does not represent the full scope of the invention, but rather the invention may be employed in different embodiments, and reference is made to the claims herein for interpreting the breadth of the invention.

BRIEF DESCRIPTION OF THE DRAWINGS

FIG. 1 is a schematic representation of a marine crane incorporating the preferred embodiment and a ship being off-loaded;

FIG. 6 is a schematic hydraulic circuit diagram showing an overload system, reversing and lockout valves and other elements also connected in the overall circuit of FIGS. 2 and 3.

DESCRIPTION OF THE PREFERRED EMBODIMENT

Figure 2:
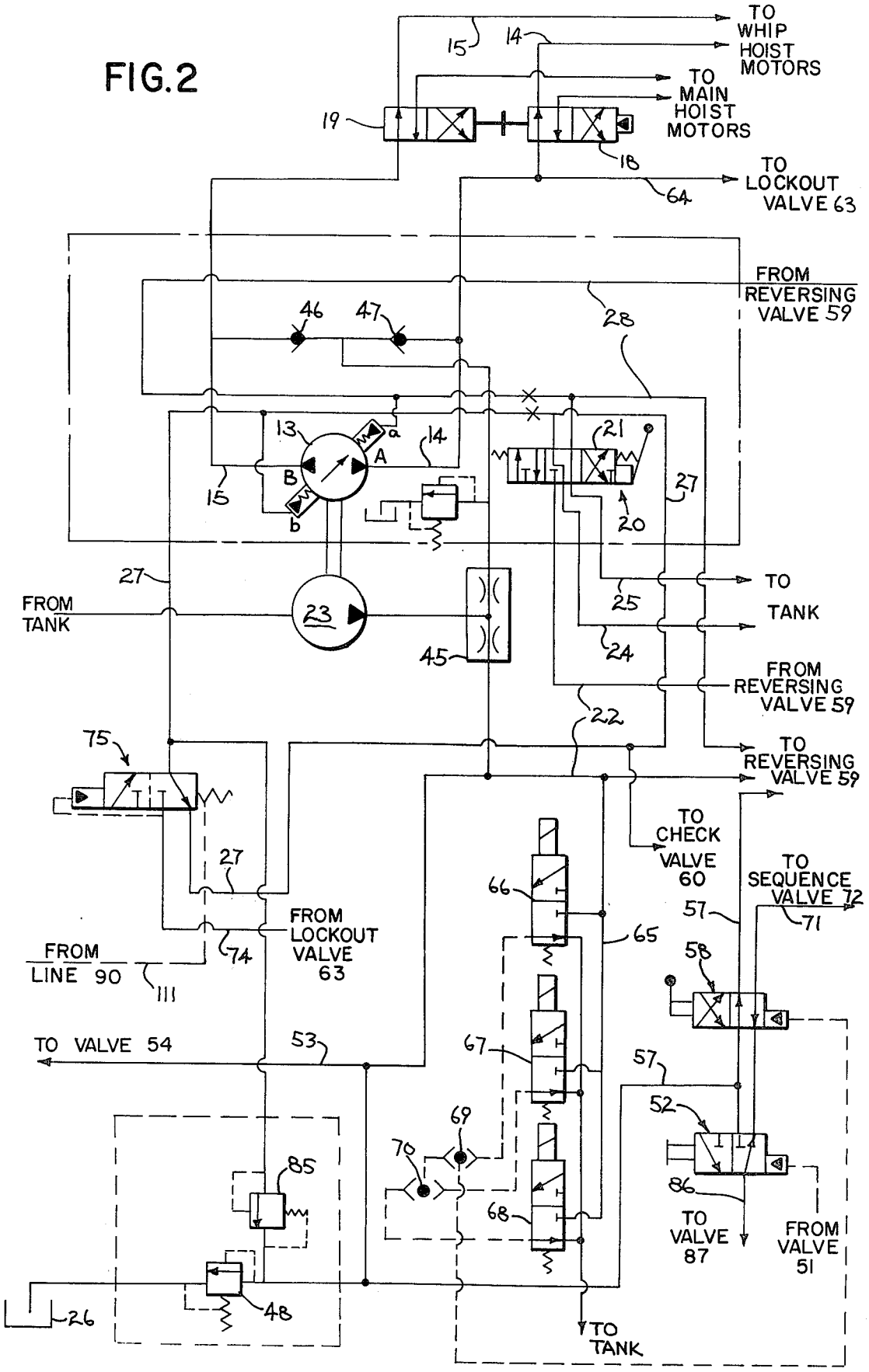
FIGS. 2 and 3 together constitute an overall schematic hydraulic circuit diagram showing the drive system for the whip hoist winch of the crane of FIG. 1, and also show certain elements of the preferred embodiment of the invention, other elements being shown in succeeding views.

Referring to FIG. 1, there is shown a marine crane 1 having a deck 2 and a machinery housing 3 rotatably mounted on a fixed pedestal 4 that may be part of an offshore platform anchored at sea, such as an oil drilling platform. An operator's cab 5 projects forward from the housing 3, and a boom 6 is suitably footed on the front end of the deck 2. The boom 6 is conventionally supported by means of an A-frame assembly 7 and stays 8. The crane 1 also has a conventional rigging arrangement for hoisting and lowering which includes a main hoist hook 9 and a whip or high speed hoist hook 10. Luffing, slewing and hoisting controls (not shown but well known to those skilled in the art) for the crane 1 operate in normal fashion except during offloading, as will hereinafter be described. As is conventional, the whip hook 10 is generally used for offloading because of its higher speed capability, and the control circuitry of the preferred embodiment controls the whip hoist.

Figure 3:
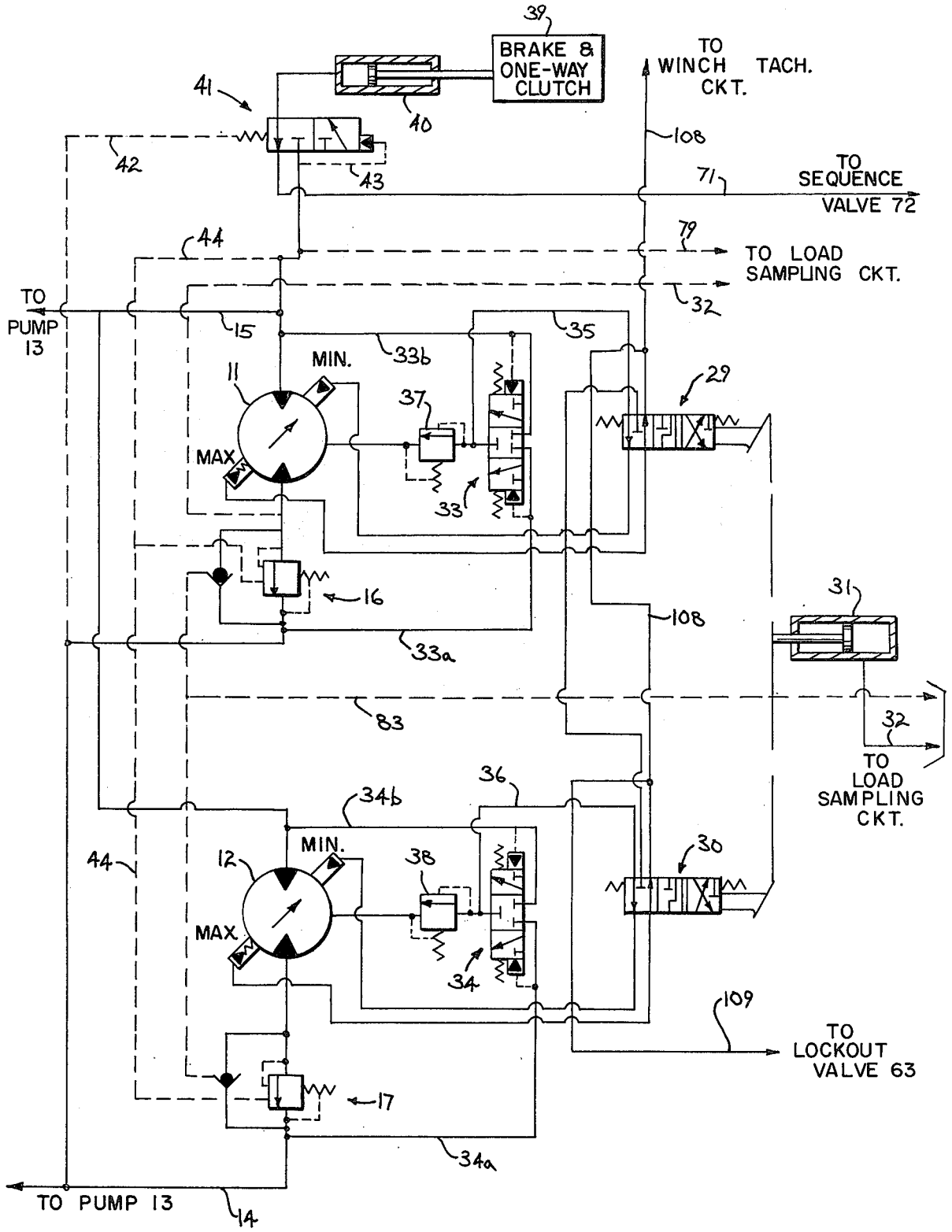

FIGS. 2 and 3 together show a schematic diagram of the overall hoist control system for the whip hook 10. The hoist control consists of a conventional hydrostatic winch drive having a pair of bi-rotational variable displacement hydraulic motors 11 and 12 (FIG. 3) adapted to drive a whip hoist winch (not shown but well known to those skilled in the art), and a reversible variable displacement axial piston pump 13 (FIG. 2) for providing hydraulic fluid to the motors 11, 12 through opposite main fluid lines 14 and 15. Thus, a closed-loop hydraulic circuit is formed between the pump 13 and motors 11, 12 so that the hydraulic fluid delivered by the pump 13 drives the motors 11, 12 to drive the whip hoist winch in either direction.

In the preferred form, the discharge of oil from port A of the pump 13 into main fluid line 14 drives the motors 11, 12 which in turn drives the whip hoist winch to draw in hoist rope and raise a load attached to the whip hoist hook 10. Alternately, the discharge of oil from port B of the pump 13 into main fluid line 15 rotates the motors 11, 12 in the opposite direction to drive the whip hoist winch to pay out rope and lower the load. Line 14 is thus referred to as the raise side main fluid line, and line 15 is the lower side main fluid line. It should also be noted that a pair of conventional counterbalance valves 16 and 17 are interposed in the main fluid line 14 on the raise side of the motors 11, 12. The purpose of the counterbalance valves 16, 17 will be more fully described below, but under normal flow conditions when the pump 13 is stroked to raise a load the flow in main fluid line 14 passes through the check valve portion of each valve 16, 17.

The hydrostatic winch drive pump shown in FIG. 2 drives not only the whip hoist but also the main hoist. For this purpose, a pair of divert valves 18 and 19 are interposed in the main fluid lines 14 and 15, respectively. Thus, when it is desired to use the main hoist hook 9 the valves 18 and 19 are shifted from the position shown in FIG. 2 to divert oil to the main hoist motor and winch (also not shown, but well known to those skilled in the art).

The pump 13 is a conventional axial piston pump with servo ports a and b associated with ports A and B, respectively. It is controlled through a control circuit which includes a variable, manually operated main control valve 20. The main control valve 20 has an axially shiftable operating spool 21 which is spring biased to a centered or neutral position. A hydraulic line 22 leads to the inlet side of the spool 21 from a source of control pressure 23, which in the preferred embodiment is a fixed displacement pump piggybacked on the main pump 13. A pair of fluid return lines 24 and 25 lead from the spool 21 to a reservoir 26. In the centered position, control pressure in line 22 is blocked at the inlet side of valve 21 so that the pump 13 is in its neutral position.

On the outlet side of spool 21 is a pair of opposite hydraulic control lines 27 and 28 which communicate with the fluid return lines 24 and 25, respectively, when the spool 21 is in its centered position as shown in FIG. 2. Control line 27 leads from the outlet of control valve 20 to servo port b of pump 13, and control line 28 leads from the outlet side of control valve 20 to servo port a of pump 13, in both cases through other elements to be described below.

The hydrostatic winch drive and its control described to this point may be considered conventional, and are known and understood by those skilled in the art. In operation, an operator directs control pressure to the servo mechanism, which controls the pump 13, by means of the control valve 20. The centered position of the control valve 20 corresponds to the neutral position of the pump 13, and consequently corresponds to a stationary position for the whip hoist winch and hook 10. In this centered position, control pressure is effectively blocked from being directed to either servo port a or b, and both control lines 27 and 28 are communicated with the reservoir 26. As a result, the servo mechanism will also be in neutral position. The whip hoist winch and hook 10 will remain stationary and will neither be raised nor lowered because the servo mechanism is spring biased into its neutral position when no control pressure is applied.

When the operator moves spool 21 of the main control valve 20 to its leftward position, control pressure is communicated from line 22 to line 28 and servo port a. This causes the pump 13 to go on stroke to discharge oil from its port A into main fluid line 14 to rotate the motors 11 and 12 and raise the whip hoist hook 10. Oil returns through main fluid line 15 to port B of pump 13, and control pressure returns through control line 27 from servo port a of pump 13 to the reservoir 26. When the operator moves spool 21 of main control valve 20 rightward, control pressure is directed through control linw 27 to servo port b causing the pump 13 to direct oil from port B into main fluid line 15 to lower the hook 10.

The displacement of the two motors 11 and 12, and therefore the speed of the whip hoist winch, is controlled by two mechanically linked motor displacement control valves 29 and 30 (FIG. 3) and a hydraulic cylinder 31 that drives them. The cylinder 31 is normally spring biased toward a minimum displacement position and is movable toward a maximum displacement position by load induced pressure in a line 32 connected to the main fluid line 14 between the lower raise side inlet port of the motor 11 and the counterbalance valve 16. As the load on the whip hoist hook 10 increases, the load induced pressure in main fluid line 14 between the motor 11 and counterbalance valve 16 also increases. This results in movement of the rod of the cylinder 31 to the left, as seen in FIG. 3, to increase the displacement of the motors and provide greater torque to pick the load.

The oil necessary to stroke the motors 11 and 12 between their minimum and maximum displacement positions is drawn from main fluid line 14 or 15 and directed through the linked valves 29 and 30 by means of a pair of flow direction valves 33 and 34. Each valve 33 and 34 may be piloted between upper and lower positions, as seen in FIG. 3, depending upon the direction of rotation of the winch drum, to direct oil through hydraulic lines 35 and 36, respectively. For exmaple, if the hydrostatic winch drive is raising a load so that main fluid line 14 is the high pressure side of the loop, oil is directed to valves 33 and 34 through lines **33*a* and 34*a* to pilot their spools upwardly so that oil from main fluid line 15 is directed, through lines 33*b* and 34*b*, to hydraulic lines 35 and 36 and then through linked valves 29 and 30 to the minimum servo ports of the motors 11 and 12. This sets minimum displacement positions for the motors 11 and 12, which means that they have the capability for maximum line speed. As previously discussed, as the load on the hook 10 increases, the mechanically linked valves 29 and 30 will be moved further and further to the left so that oil will begin being directed into the maximum servo ports of the motors 11, 12 to increase their displacements to provide greater torque to lift the load. Pressure in hydraulic lines 35 and 36 leading to the servo ports of the motors 11, 12 is limited by the setting of the relief valves 37 and 38 to about 160 psi. It should also be noted that when the valves 33 and 34 are in their centered positions oil is blocked from reaching the servo ports of the motors 11 and 12. Under these circumstances, the motors 11 and 12** are automatically spring driven to their maximum displacement positions.

In accordance with standard practice, a normally set winch brake means comprising an automatic brake and clutch arrangement 39 (shown only schematically in FIG. 3) for the winch is provided, and is controlled by a hydraulic release means comprising a brake cylinder 40 and brake release valve 41. The brake is a spring set, hydraulically released brake which in normal operation prevents the winch drum from rotating until the operator moves the main hoist control valve from neutral positon. It operates through a one way, overrunning clutch so that the brake effectively operates in only one direction, that is to prevent lowering of the load. The brake release valve 41 is a pilot operated, two-position valve with one pilot connecton 42 leading to the main fluid line 14 and a second pilot connection 43 leading to the main fluid line 15. The brake release valve 41 is spring biased to the position shown in FIG. 3, and is set to require a pressure differential of about 100 psi to overcome the spring bias. Therefore, if the pressures in pilot lines 42 and 43 are equal, the valve 41 is not piloted and remains in the position shown in FIG. 3. The result is that the brake cylinder 40 is not actuated, and the brake is set on the winch drum. If there is high pressure on the raise side of the hydrostatic drive, i.e. in main fluid line 14, and therefore in pilot line 42, the valve 41 still remains in the position shown in FIG. 3 since pilot line 42 leads to the spring side, and the brake remains set on the drum. However, if there is high pressure on the lower side of the hydrostatic drive, i.e. in main fluid line 15, and consequently in pilot line 43, and once the pressure differential across the valve 41 becomes greater than 100 psi, the valve 41 will be piloted to the left from the position shown in FIG. 3. This position allows pressure to be communicated from main fluid line 15 to the brake cylinder 40 to release the brake and allow the winch drum to pay out rope. It should also be noted that a pilot line 44 is connected to main fluid line 15 and leads to the counterbalance valves 16 and 17. This line 44 functions to pilot the counterbalance valves 16 and 17 to their open positions so that oil may pass through the motors 11, 12 and main fluid line 14 to the pump 13 when lowering a load.

Referring now to FIG. 2, oil from the pump 23 is directed toward a flow splitter 45 which provides equal oil flow in two directions. Oil flowing upwardly from the flow splitter passes through a pair of check valves 46 and 47 to main fluid lines 14 and 15 of the hydrostatic winch drive and provides cooling and make-up oil. Oil flowing downwardly from the flow splitter 45 provides control pressure and leads into the control circuit. A main relief valve 48 provides overall control pressure of about 650 psi.

Following control pressure downwardly from the flow splitter 45, it can be seen that the first line is hydraulic line 22 which, as previously described, leads to the inlet port of the manual control valve 20. A line 49 (FIG. 6) leads from hydraulic line 22 through a shuttle valve 50 to the inlet of a signal gate valve 51. If valve 51 is in the position shown in FIG. 6, control pressure passes through to a manually-operated lift selection valve 52 (FIG. 2). This provides a mechanism for preventing valve 52 from being manually actuated during normal operation of the hydrostatic winch drive and upon the occurrence of an overload situation, as will hereinafter be more fully described.

Figure 5:
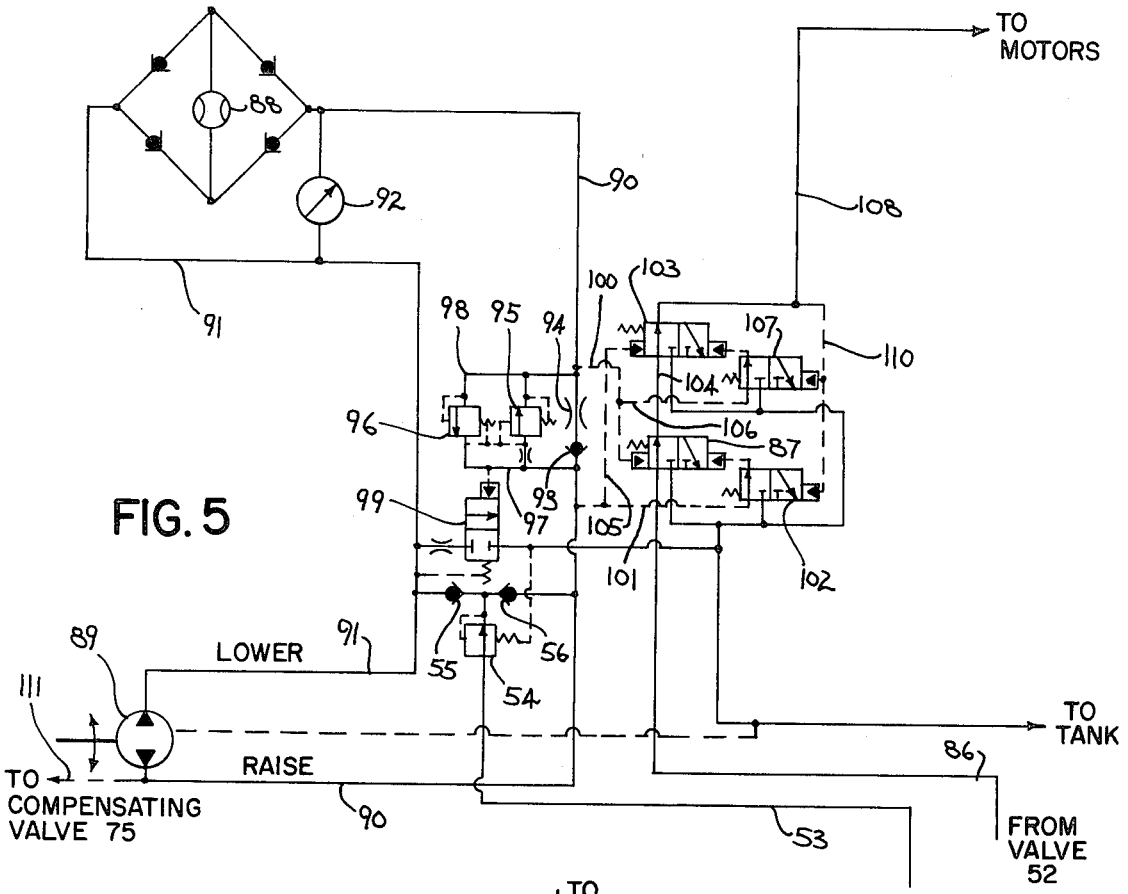
FIG. 5 is a schematic hydraulic circuit diagram showing a winch tachometer circuit also connected in the overall circuit of FIGS. 2 and 3.

Another line 53 of control pressure leads to a closed-loop winch tachometer circuit shown in FIG. 5. Control oil is directed through reducing valve 54 which reduces the pressure in the winch tachometer circuit from about 650 psi to about 100 psi, and then through a pair of check valves 55 and 56 to provide cooling and make-up oil for that system.

A third control line 57 leads to the inlet of valve 52 where it is blocked in the position of valve 52 as shown in FIG. 2. Line 57 also leads to the inlet of a manually operated compensator selection valve 58, which functions as a heave compensating mode initiation valve, and with the valve 58 in the position shown in FIG. 2 continues on to the spring side of a reversing valve 59 (FIG. 6) and is stopped by a pilot pressure quarantee check valve 60. Control pressure on the spring side of reversing valve 59 insures that valve 59 will be in the position shown in FIG. 6. It should be noted that control pressure in line 22 passes through reversing valve 59, when valve 59 is in its spring offset position, to be directed to the inlet of the manual control valve 20. Another line 61 leads from hydraulic line 57 and directs control pressure through a shuttle valve 62 to pilot a lock-out valve 63 to the left from the position shown in FIG. 6. In its piloted position, lock-out valve 63 blocks hydraulic line 64, which leads from the inlet of lock-out valve 63 to main fluid line 14 to sense the pressure in main fluid line 14.

Another control pressure line 65 (FIG. 2) leads from line 22 to an ATB solenoid valve 66 and two divert solenoid valves 67 and 68. The first solenoid valve 66 is actuated when a conventional anti-two block, or ATB, control circuit (not shown) is actuated. The anti-two block circuit provides a mechanism for shutting off the winch if a load is hoisted so high on the crane that there is danger that the hook 10 and its corresponding support blocks will be damaged by hitting the boom point. It shuts down the reeling-in operation of the winch, and when this occurs the ATB solenoid valve 66 is also actuated to permit control pressure to pass through a shuttle valve 69 to the right-hand side of the compensator selection valve 58 to prevent its manual actuation.

The two divert solenoid valves 67 and 68 function basically for the same purpose as valve 66 except with different systems. Divert solenoid valve 67 is actuated when the divert valves 18 and 19 are actuated, which means that the main hoist system is operational. Divert solenoid valve 68 is actuated when the main hoist double pumping system (not shown, but well known to those skilled in the art) for the crane 1 is being operated. If either of valves 67 or 68 becomes actuated, control pressure passes through a shuttle valve 70 and then through the shuttle valve 69 to the right-hand side of the compensator selection valve 58. It can thus be seen that the valve 58 may only be manually actuated when the whip hoist system is being used, and is inoperative when the double pumping system, main hoist system or ATB circuit is operational.

When compensator selection valve 58 is shifted to the right, oil is taken from hydraulic line 57 and directed into line 71. Line 71 leads in two branches to a sequence valve 72 (FIG. 4) and the brake cylinder 40 (FIG. 3) through the brake release valve 41. Since the brake cylinder is set to be released at about 100 psi and sequence valve 72 is set to be piloted at about 500 psi, the pressure in line 71, at this particular instant in time, will first be directed to the branch leading to brake cylinder 40 through valve 41. After the brake is released, control pressure instantaneously builds up in line 71 to its relief setting of 650 psi to pilot the sequence valve 72 to the left from the position shown in FIG. 4. A line 73 (FIG. 6) leads from hydraulic line 71 and directs control pressure to the lower end of signal gate valve 51 to pilot its spool upwardly, from the position shown in FIG. 6. This blocks control pressure at the inlet to valve 51 and takes control pressure away from the right-hand side of lift selection valve 52. As a result, valve 52 may be manually actuated when desired.

Upon the actuation of valve 58, control pressure is also taken from the left-hand side of reversing valve 59 and the right-hand side of lock-out valve 63. Since reversing valve 59 is normally spring offset to the right, control pressure continues to be directed through line 22 to the inlet of manual control valve 20. However, the removal of control pressure from line 61 also causes lock-out valve 63 to spring offset to the right. This permits pressure from line 64 to be directed through hydraulic line 74 to a compensating valve 75 (FIG. 2). Compensating valve 75 is a modulating type of valve whose function will hereinafter be described. However, assuming the pump 13 is in its neutral position at this point in time, there is only charge pressure (about 200 psi) in main fluid line 14 and hence in lines 64 and 74. Compensating valve 75 is set at about 1,500 psi, and so valve 75 is not actuated and remains in the position shown in FIG. 2.

Figure 4:
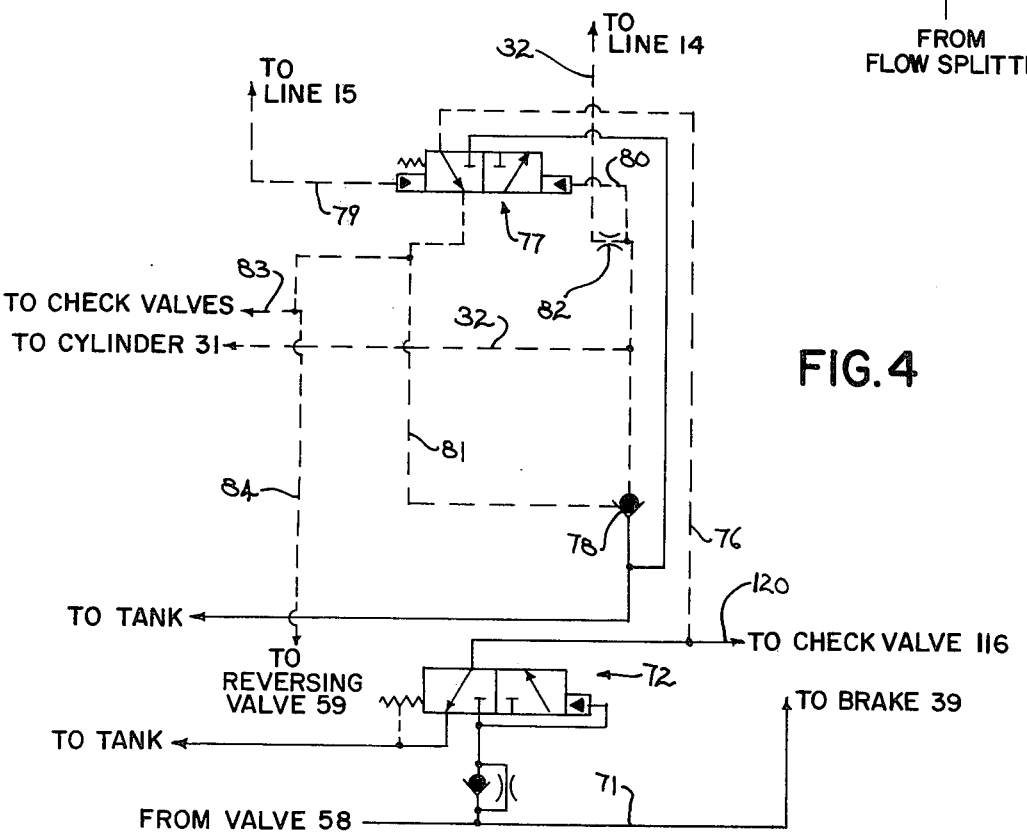
FIG. 4 is a schematic hydraulic circuit diagram showing a load sampling circuit connected in the overall circuit of FIGS. 2 and 3.

After sequence valve 72 is piloted to the left from the position shown in FIG. 4, control pressure is directed through hydraulic line 76 to a load sampling system. The load sampling system senses the initial load imposed upon the hook 10 and prevents the actuation of the reversing valve 59 and compensating valve 75 if the load is greater than a predetermined limit. The load sampling system includes a pilot-operated load sampling valve 77 and a pilot-operated check valve 78 that serves as a bleed valve as will be described. The load sampling valve 77 has a pilot line 79 communicating between its left side and the main fluid line 15, and a second pilot line 80 communicating between its right-hand side and line 32. It can thus be seen that pilot line 79 is indicative of the pressure in main fluid line 15, and pilot line 80 is indicative of the load induced pressure in main fluid line 14. Since valve 77 is set at about 100 psi it can be seen that whenever the load induced pressure in line 80 is 100 psi greater than the pressure in line 79 the load sampling valve 77 will be piloted to the left. If the difference in pressure is less than 100 psi, valve 77 will remain spring offset to the right as shown in FIG. 4. In the preferred embodiment, there is a charge pressure of about 200 psi in line 15, and line 79, which means that the pressure in line 14, and line 80, must be about 300 psi, to pilot the valve 77, which in turn means that a load of about 1,000 lbs. will pilot the valve 77. Thus, the load sampling system prevents initiation of the heave compensating mode while there is a load of 1,000 lbs. or more on the hook 10, which might for example result from accidental actuation of valve 58 during a normal lifting operation. Should this occur, the valve 77 will pilot and the load will simply be held stationary.

The heave compensating mode is initiated by actuating the valve 58 when the load on the hook 10 is less than about 1,000 lbs. This may result from the actual load weight being less than that, or, more normally, when the valve 58 is actuated after the slings have been fastened but before the hook 10 has been raised enough to start lifting. Actuation of valve 58 will then direct control pressure through load sampling valve 77 to accomplish three objectives. First, it opens check valve 78 by directing control pressure through line 81. The opening of check valve 78 bleeds off pressure from the right side of load sampling valve 77 so that this valve cannot be piloted to the left. It also bleeds off pressure in the load induced pressure line 32 leading to the hydraulic cylinder 31 controlling the linked valves 29 and 30; an orifice 82 in the line 32 insures that pressure will be reduced in that portion of the line that is downstream of the orifice, that being the portion leading to the cylinder 31. Thus, all pressure is removed from the linked valves 29 and 30 so that they become spring offset. This permits charge pressure from main fluid line 15 to be delivered to the minimum servo ports of the motors 11, 12, as previously described. As a result, the motors 11, 12 are stroked to their minimum displacement, which provides maximum line speed capability.

Secondly, control pressure passing through valve 77 opens the check valves of the counterbalance valves 16 and 17 in main fluid line 14 by means of hydraulic line 83. This results in the hydrostatic winch drive having the capability of bypassing the counterbalance valves 16 an 17 with oil flowing in either direction. Finally, control pressure passing through valve 77 is directed through another line 84 to pilot reversing valve 59 to the left from the position shown in FIG. 6. This directs control pressure from line 22 into control line 28 which leads to servo port a of the pump 13. This strokes the pump 13 to discharge oil through its port A into main fluid line 14. This also diverts all control pressure leading from the outlet of reversing valve 59 to the inlet of the main control valve 20 resulting in neutralizing and overriding valve 20 to prevent manual operation thereof.

Prior to actuating the valve 58, the crane operator should increase the engine speed to the main drive pump 13 to its maximum setting so that the pump 13, and as a result the motors 11 and 12, have the capability to obtain maximum line speed. As noted above, the motors 11, 12 have charge pressure stroking them to their minimum displacements. Thus, with the pump 13 rotating at its maximum speed and the motors 11, 12 at their minimum displacements, the hydrostatic winch drive has the capability of obtaining maximum line speed.

When the main drive pump 13 has thus been stroked into its raise mode whereby it discharges oil into line 14 through port A, high pressure is not only delivered to the motors 11 and 12, but is also delivered through lock-out valve 63 to compensating valve 75 via hydraulic lines 64 and 74, the compensating valve 75 thus being connected between main line 14 and the other control line 27 leading to servo port b. The compensating valve 75 is a modulating type valve having a spring setting of about 1,500 psi. Thus, if the pressure in line 74, which reflects pressure in line 14, reaches about 1,500 psi, valve 75 will be piloted to the right from the position shown in FIG. 2 to allow a regulated pressure signal to be directed into control line 27 leading to servo port b of the pump 13. The function of the compensating valve 75 is to regulate the displacement of the pump 13 so that the pump 13 develops only a predetermined pressure in main fluid line 14 which will allow the system to develop a line pull on the hoist rope of about 2,500 to 3,500 lbs. To this end, the regulated pressure admitted to servo port b of the pump 13 through compensating valve 75 acts to offset the effect of full control pressure being directed to servo port a of pump 13, through control line 28, when the reversing valve 59 is piloted to the left. The maintenance of regulated pressure in line 14 results in a heave compensating action that differs according to load weight as will now be described.

If the load being picked up from the ship is what can be termed a light load, 2,500 lbs. or less in the preferred embodiment, the pump 13 will be stroked by control pressure directed into its servo port a to increase its displacement and discharge oil into main fluid line 14. However, since the weight of the load is less than 2,500 lbs., and since the compensating valve 75 is set at 1,500 psi, the valve 75 will never be piloted to the right to allow pressure to enter servo port b of the pump 13. As a result, the pump displacement will continue toward maximum and the load will be lifted off the ship at maximum line speed. When the load is sufficiently clear of the ship, the crane operator may disengage valve 58 and continue to raise the load manually via control valve 20.

If the load to be lifted off the ship is what can be termed as a balanced load, between 2,500 and 3,500 lbs. in the preferred embodiment, the line pull generated by the system will approximate the weight of the load. As a result, as the load and ship are rising on a wave, the winch drive will be generating enough line pull to draw in hoist rope and keep pace with the rising load, keeping the hoist rope in approximately constant tension. When the ship and load get to the top or crest of a wave, the winch drive will still be generating between 2,500 to 3,500 lbs. of line pull. When the ship begins to fall away from the load, the load will remain suspended in the air since the line pull approximately equals the weight of the load. Compensating valve 75 will be caused to be shifted to the right just enough to cause the appropriate amount of regulated pressure to enter servo port b of the pump 13 to offset the control pressure entering servo port a so that the pump 13 goes on stroke only enough to generate 2,500–3,500 lbs. of line pull. Under these circumstances, the drive pump 13 is nearly at zero displacement. The pressure in control line 28 is slightly greater than the regulated pressure in control line 27. Consequently, the crane operator must in this situation disengage valve 58 and continue to raise the load manually via control valve 20.

In situations involving a heavy load, 3,500 lbs. or greater in the preferred embodiment, the pump 13 is, again, stroked by control pressure to discharge oil into main fluid line 14 and its displacement is regulated by compensating valve 75 so that the system develops about 2,500 to 3,500 lbs. of line pull to keep the hoist rope in approximately constant tension. Under these circumstances, when the heavy load reaches the crest of a wave, it will not be picked off of the ship, and it will not remain suspended, but rather it will fall with the ship. Since the system is developing only 2,500 to 3,500 lbs. of line pull and the weight of the load is greater than 3,500 lbs., when the ship and load begin to fall into the trough of a wave, the load causes the motors 11, 12 to act as pumps and actually cause oil to flow in reverse direction in main fluid line 14 from the motors 11, 12 toward the pump 13. In other words, the motors are acting as pumps and causing flow to be discharged back towards port A of pump 13. As this occurs, the high pressure flow in main fluid line 14 is communicated to the compensating valve 75 which in turn is piloted to permit pressure to enter servo port b of pump 13. Under these circumstances, the pressure entering servo port b of pump 13 is greater than the control pressure entering servo port a, and as a result the pump 13 is caused to be stroked to swallow the oil being pumped by the motors 11, 12 into its port A. As a result, the winch drum is paid out, and the load falls with the ship. It should be noted, however, that the hoist rope is still under constant tension since the pump 13 will be stroked to swallow only enough oil so as to maintain line pull of about 2,500–3,500 lbs.

It should be noted that the regulated pressure between compensating valve 75 and servo port b of the pump 13 is never greater than about 950 psi due to the combination of a pressure relief valve 85 set at about 300 psi and the control pressure relief valve 48 set at 650 psi. The 950 psi limit is necessary so that the pressure capabilities of pump servo ports a and b are never exceeded.

Up to this point of the description for heavy loads, the hoist control has been described in its heave compensating mode. As a result, the load, although attached to the crane hook 10, will continue to remain on the ship's deck with the crane winch automatically paying out and taking in hoist rope to follow the vertical movement of the ship. The hoist control will remain in the heave compensating mode until the crane operator either deactivates valve 58 and reverts to manual control, or actuates valve 52 to place the system into an automatic lift mode. It should be remembered that if the load was a light load, i.e. less than about 2,500 lbs., it would have been lifted from the ship immediately upon the actuation of valve 58 putting the winch drive into its heave compensating mode. Also, if the load was a balanced load, i.e. between about 2,500 to 3,500 lbs., the load would have remained suspended in the air when the ship reached the top or crest of a wave and began falling away from the load. Only if the load is greater than 3,500 lbs. will it remain on the ship and follow the rise and fall of the ship in the heave compensating mode. Therefore, the actuation of valve 52 is only necessary to pick a load which is greater than 3,500 lbs. It should also be remembered that the motors 11, 12 have been stroked to their minimum displacement to provide maximum line speed capability due to the piloting open of check valve 78.

Upon the actuation of valve 52, control pressure is directed through a hydraulic line 86 to the inlet of a sensing valve 87 in the winch tachometer circuit shown in FIG. 5. The winch tachometer circuit serves as a winch speed sensing means and includes a flow meter 88 and a motor 89 that is driven off the winch drive motors 11, 12 and provides fluid to the flow meter 88 through opposite hydraulic lines 90 and 91. The flow meter 88 is preferably located in the operator's cab. The flow rate in hydraulic lines 90 and 91 is proportional to the speed of the winch drive motors 11 and 12 and the flow meter is calibrated in terms of percentages, so its read-out tells the operator the winch motors are operating at a certain percentage of their maximum speed. There is also a bridge circuit around the flow meter 88 which guarantees that oil will flow through it in only one direction regardless of whether oil is being directed to the meter through hydraulic line 90 or 91. As a result, the meter 88 simply shows speed, and not direction. There is, however, a conventional indicator 92 connected across the hydraulic lines 90 and 91 which indicates whether the winch motors 11, 12 are taking in or paying out rope.

A check valve 93 is disposed in hydraulic line 90 to allow flow from the motor 89 through a pressure compensated orifice 94 to the flow meter 88, but not in the reverse direction. The pressure compensated orifice 94 is in hydraulic line 90 between the check valve 93 and the flow meter 88. The orifice 94 serves as a flow control means and guarantees a flow rate of about 1.5 gpm. to the flow meter 88 regardless of the pressure on its upstream side. The winch tachometer circuit also includes a pair of relief valves 95 and 96 connected across the check valve 93 and orifice 94 by hydraulic lines 97 and 98. Line 97 is connected to hydraulic line 90 between the check valve 93 and motor 89, and line 98 is connected to hydraulic line 90 between the orifice 94 and flow meter 88. Relief valve 95 permits oil in hydraulic line 90 to by-pass the check valve 93 and orifice 94 should the pressure developed on the upstream side of orifice 94 become greater than a predetermined safe limit, and relief valve 96 permits oil to flow from the flow meter 88 to the motor 89 and bypass the check valve 93 during the lowering of a load.

Cooling and make-up oil is also provided for the winch tachometer circuit. A valve 99 is piloted off line 97, and whenever there is sufficient pressure in line 97 the valve 99 opens to direct hot oil from hydraulic line 91 to the main reservoir 26. Make-up oil is provided by control pressure from branch line 53 which passes through reducing valve 54 and through the check valves 55 and 56 to serve as replenishment for the closed-loop tachometer circuit.

The sensing valve 87 is pilot operated between a closed position and an open position. The valve 87 has a pair of pilot lines 100 and 101 for shifting its spool between its alternative valve positions. Pilot line 100 leads from the left-hand side of valve 87, as seen in FIG. 5, to hydraulic line 90 between the orifice 94 and the flow meter 88, and pilot line 101 leads from the right-hand side of valve 87 to hydraulic line 90 between the check valve 93 and the motor 89. Interposed in line 101 is a holding valve 102. The holding valve 102 is spring biased to an open position, but may be piloted to a closed position, as will be described.

The outlet of sensing valve 87 leads to the inlet of a second sensing valve 103 via hydraulic line 104. Sensing valve 103 is identical to valve 87 and is connected across check valve 93 and orifice 94 by means of a pair of pilot lines 105 and 106. Pilot line 105 leads from the left side of valve 103 to pilot line 101 and pilot line 106 leads from the right-hand side of valve 103 to pilot line 100. A second holding valve 107 is interposed in pilot line 106. Holding valve 107 functions in the same manner as valve 102 and is spring biased to open position to allow pilot oil to communicate with the right side of sensing valve 103, but may be piloted to a closed position, as will be described.

The outlet of sensing valve 103 leads via hydraulic line 108 to the maximum servo ports of main drive motors 11 and 12 through the linked valves 29 and 30 (FIG. 3). It should be noted that the linked valves 29 and 30 will be in the positions shown in FIG. 3 since during the heave compensating mode pressure is bled from the hydraulic cylinder 31 which controls the position of the valves 29 and 30. Another hydraulic line 109 branches off from line 108 and communicates through shuttle valve 62 to the right side of lock-out valve 63. Another line 110 (FIG. 5) leads from hydraulic line 108 to the right sides of holding valves 102 and 107 to pilot these valves when necessary.

A feed back line 111 (FIGS. 2 and 5) is between hydraulic line 90 and the spring side of compensating valve 75. The sole function of the feed back line 111 is to compensate for the gear box and drum rotation frictional losses of the winch drive. In other words, the feed back line 111 compensates for the forces required to rotate the gear box and winch drum without generating any line pull at all. It should be noted, however, that feed back line 111 is operational only in the raise direction, i.e. when a load is rising on a wave, since these inherent losses of the winch drive need only be overcome by the pump 13 and motors 11, 12 when the drum is hauling in rope. For example, when the load is rising on a wave, the feed back line 111 is at a relatively high pressure since hydraulic line 90 is under relatively high pressure. As a result, compensating valve 75 will not be piloted to allow a regulated pressure signal to reach servo port b of pump 13 until the pressure in hydraulic line 74 is sufficiently great enough to overcome both the spring setting of the valve, approximately 1,500 psi, as well as any pressure in feed back line 111. This allows the pump 13 to go on stroke the additional necessary amount to overcome the frictional forces of the gear box and winch drum. However, when the load is falling on a wave, hydraulic line 91 in the winch tachometer circuit is under relatively high pressure and hydraulic line 90 is under relatively low pressure. Therefore, feed back line 111 is under relatively low pressure and the compensating valve 75 need only overcome its spring setting to allow a regulated pressure to servo port b of the pump 13. This allows compensating valve 75 to shift at a considerably lower pressure than when the load is rising because the pump 13 and motors 11, 12 need not overcome the frictional forces of the gear box and winch drum since the load itself is overcoming these forces as it falls on a wave and pulls out rope from the hoist drum.

The lift control system consisting of the lift selection valve 52 and winch tachometer circuit becomes functional only subsequent to the actuation of direction selection valve 58 which places the system into a heave compensating mode since prior to that time control pressure via line 49 is directed to prevent its actuation. In order to fully appreciate the manner in which the lift control system determines the optimum time a lift should be initiated it is necessary to describe its operation not only when a load is rising on a wave, but also when the load is falling. The optimum time for lifting a rising load is at or near the wave crest, and the optimum time for pickup of a falling load is at the trough. In essence, the sensing valves 87 and 103 serve as speed-responsive valve means to insure lift off only when winch speed is less than a predetermined rate, at or near zero in the preferred embodiment, which means that the load is at or near a crest or trough.

When a load on the deck of a supply ship is rising with a wave and the winch drive is in its heave compensating mode, hydraulic line 90 is the high pressure line of the winch tachometer circuit and hydraulic line 91 is the low pressure line. Sensing valve 87 is set so that the pressure in hydraulic line 90 on the inlet side of check valve 93 and orifice 94 must be at least 200 psi greater than the pressure on the outlet side of orifice 94 in order to pilot sensing valve 87 to its closed position, and this differential exists while the load is rising. Thus, when lift selection valve 52 is actuated by the crane operator while a load is rising, control pressure will be directed into hydraulic line 86 and be blocked at the inlet to sensing valve 87. This prevents control pressure from reaching the maximum servo ports of the motors 11, 12. As the load and ship approach the crest of a wave their velocities begin to slow and consequently so also do the main drive motors 11, 12 and winch tachometer motor 89. This results in a slower flow rate through hydraulic line 90 which in turn results in a decrease in the pressure differential across the check valve 93 and orifice 94. When this pressure differential is less than the spring setting of sensing valve 87, valve 87 will move to its open position. This results in control pressure passing through sensing valve 87, and since sensing valve 103 will also be spring offset under these conditions, control pressure will pass through it and into hydraulic line 108 where it is directed to the maximum servo ports of motors 11, 12. This control pressure strokes the motors to their maximum displacement positions. At substantially the same time control pressure is directed through hydraulic line 110 to pilot holding valves 102 and 107 to their closed positions. This results in sensing valves 87 and 103 remaining in their spring offset positions to allow control pressure to continuously reach the maximum ports of motors 11, 12.

Since the motors 11 and 12 are being commanded to go to full stroke by control pressure at their maximum servo ports, for any constant flow of oil from the main drive pump 13, the motors 11, 12 will actually slow down. This is the necessary result of increasing displacement while keeping the flow to the motors 11, 12 constant. Nevertheless, the winch drive must insure that there is sufficient line speed developed so that a load is not allowed to drop before the winch drum lifts it off the ship. This is accomplished by isolating or blocking out compensating valve 75 so that the pump 13 may be commanded to its maximum raise stroke. When the motors 11, 12 are stroked to their maximum displacement, control pressure is also directed into hydraulic line 109 and through shuttle valve 62 to the right side of lock-out valve 63. As a result, lock-out valve 63 is piloted to the left to its closed position. This blocks communication to or isolates compensating valve 75 and it no longer receives a pressure signal from main fluid line 14. Once compensating valve 75 has been isolated, control pressure still present at servo port a strokes pump 13 to its maximum raise displacement to insure that a sufficient amount of oil is being discharged through main fluid line 14 to the motors 11 and 12 to provide maximum line speed. The load is thus rapidly hauled upwardly clear of the ship.

As the winch begins to hoist the load, hydraulic line 90 in the winch tachometer circuit will once again have pressure resulting in a pressure differential greater than 200 psi across check valve 93 and orifice 94. However, since holding valves 102 and 107 have been piloted to their closed positions, sensing valves 87 and 103 are insensitive to this pressure differential and as a result continue to permit control pressure to the motors 11, 12.

When a load is falling on a wave and lift selection valve 52 is actuated, the winch tachometer circuit has relatively high pressure in hydraulic line 91 and relatively low pressure in hydraulic line 90. Since the pressure in hydraulic line 90 leading from the flow meter 88 to check valve 93 will be greater than the pressure in line 90 between the check valve 93 and motor 89, sensing valve 87 will be spring offset to its open position to permit control pressure in line 86 to pass through its spool to the inlet of sensing valve 103. However, this same pressure differential results in sensing valve 103 being piloted to the left and blocking control pressure from being directed toward the maximum servo ports of motors 11, 12. Therefore, even though lift selection valve 52 has been actuated the winch drive at this instant in time, as the load is falling on a wave, is still acting as if it is in a heave compensating mode.

When the load reaches the trough of a wave, i.e. when the load stops falling, the winch drum, and hence the winch tachometer motor 89, is not turning, with the result that there is no flow through hydraulic lines 90 and 91 in the winch tachometer circuit. It should be noted, however, that prior to this time relief valve 96 has insured that there is at least a 200 psi pressure drop across the orifice 94 and check valve 93. Thus, when the flow through hydraulic lines 90 and 91 stops, the pressure differential across the orifice 94 and check valve 93 will no longer be 200 psi. Therefore, sensing valve 103 becomes spring offset to its open position and allows control pressure to be directed through hydraulic line 108 to the maximum servo ports of the motors 11 and 12. Simultaneously, lock-out valve 63 is piloted to isolate compensating valve 75 and holding valves 102 and 107 are piloted causing sensing valves 87 and 103 to become insensitive to the pressure differential in the winch tachometer circuit. Once compensating valve 75 is blocked out of the system, the pump 13 is stroked to its maximum displacement by control pressure still present at servo port a. Thus, with pump 13 at maximum displacement and motors 11, 12 at maximum displacement the load is hauled clear of the ship at the maximum line speed capable for that load.

Once the load sufficiently clears the supply ship, the crane operator may switch back to a manual raise mode. The operator must first move the hoist control lever of the main control valve 20 to its full stroke raise position, and then while holding this lever in its full stroke position, disengages compensator selection valve 58. The manual disengagement of valve 58 automatically causes shifting of reversing valve 59 to the right enabling control pressure in line 22 to be directed to the inlet of main control valve 20. This also directs control pressure into line 49 and through shuttle valve 50 and valve 51 to disengage lift selection valve 52. The crane operator now has full manual control of the load, and can operate his hoist, slew and luff controls to direct the load to its desired location on the platform.

An overload system is also provided for the hydrostatic winch drive. Once in the lift control mode with pump 13 and motors 11, 12 at their maximum raise stroke, a kick-out valve 112 is used to determine whether the load is above the rating of the machine for a particular boom angle. Kick-out valve 112 is a two-position, pilot operated valve having its inlet connected to hydraulic line 64 via line 113. Kick-out valve 112 preferably has a spring setting of about 1,500 psi and is normally spring offset to its closed position with its outlet leading via hydraulic line 114 to shuttle valve 50 and the left side of lock-out valve 63. The overload system also includes a boom angle sensor (FIG. 6) of any conventional design which directs a regulated pressure signal indicative of the boom angle via hydraulic line 115 to a check valve 116. Check valve 116 is connected via another hydraulic line 117 to the spring side of kick-out valve 112, and by line 118 to another check valve 119 which in turn is connected to hydraulic line 113. Check valve 116 is also connected via hydraulic line 120 to hydraulic line 76 on the outlet side of sequence valve 72. Check valve 119 also communicates via line 121 with hydraulic line 49.

During normal hoisting and lowering operations when the system is not in its heave compensating or lift control modes, control pressure is directed in line 49 through shuttle valve 50 and valve 51 to prevent the actuation of lift selection valve 52. Consequently, control pressure is also directed through line 121 to pilot check valve 119. This results in the pressure in main fluid line 14 being communicated to both sides of kick-out valve 112 via hydraulic line 64 and lines 117 and 118. This results in kick-out valve 112 remaining in its spring offset or closed position. However, upon the actuation of compensator selection valve 58, placing the hoist control system into a heave compensating mode, control pressure is taken away from hydraulic lines 49 and 121 and directed into hydraulic lines 76 and 120. Thus, check valve 116 will be moved to its open position allowing the boom angle regulated pressure signal to be directed into lines 117 and 118. As a result, the kick-out valve 112 becomes operational and begins to compare the boom angle regulate pressure signal with the pressure sensed in main fluid line 14. Thus, when the crane is placed into its automatic lift control mode and the load it is attempting to lift is greater than its maximum rating, or the load catches on a rail or other protuberance on the superstructure of the supply ship, the pressure in main fluid line 14 will continue to rise as the crane attempts to lift the overload until such time as kick-out valve 112 is piloted open. Pressure is then directed into line 114 and through shuttle valve 50 and valve 51 to kick the system out of automatic lift mode by deactuating lift selection valve 52. Simultaneously, pressure in line 114 is directed to the spring side of lock-out valve 63 to cause its spool to be spring offset and communicate pressure from hydraulic line 64, which is indicative of the pressure in main fluid line 14, to the compensating valve 75. Thus, once kick-out valve 112 is actuated, the winch drive returns to its heave compensating mode to be regulated by compensating valve 75 so that the load can raise and fall with the ship.

A hoist control for a marine crane has been described that includes a heave compensating system for automatically controlling the crane winch to compensate for the vertical movement of a load on a ship's deck. A lift control is also included for automatically hoisting the heaving load at its optimum point of lift-off to minimize the impact load imposed on the crane and to provide high speed for rapidly hauling the load clear of the ship's deck. The heave compensating and lift control systems may be incorporated with various hoist controls for marine cranes, and may be designed for any size winch desired.

Although a preferred embodiment of the invention has been shown and described, it will be obvious that variations might be made without departure from the spirit of the invention. The invention is not, therefore, intended to be limited by the showing or description herein or in any other manner, except insofar as may specifically be required.

I claim:

1. In a hoist control for a marine crane having a birotational variable displacement hydraulic winch motor, a reversible variable displacement hydraulic pump operably connected to the motor through opposite main fluid lines, and a control valve operably connected to the pump through a control circuit including control lines leading to opposite sides of the pump, the combination of:

selectively operable means to divert control pressure from the control valve and direct it through one of the control lines to cause the pump to deliver high pressure fluid to one of the main fluid lines; and a compensating valve connected between said one main fluid line and the other control line, said compensating valve being responsive to pressure in said one main fluid line and operable to admit said pressure to said other control line so that the pump develops only a predetermined pressure in said one main fluid line, said predetermined pressure resulting in a predetermined line pull that is sufficient to lift a load in a selected light range, but that will allow relative vertical movement of a load in a selected heavy range while maintaining essentially constant line pressure.

2. The combination of claim 1, wherein said selectively operable means comprises:

a reversing valve in said one control line and having a first position in which it passes control pressure to the control valve and a second position in which control pressure bypasses the control valve and is directed to the pump; and a compensator selection valve in the control circuit and operable to shift the reversing valve between its said positions.

3. The combination of claim 2, wherein:

there is a normally set winch brake means to prevent lowering of a load and having hydraulic release means operable at a certain pressure;

the control circuit includes a branched line having one branch leading to the release means and the other branch leading to the reversing valve; and there is a normally closed sequence valve in said other branch that is set to open to admit control pressure to the reversing valve only after there is sufficient pressure in said one branch to release the brake means.

4. The combination of claim 2, further including a load sampling system for sensing the load imposed upon the winch and preventing the actuation of said reversing and compensating valves if said load is greater than a predetermined limit, said load sampling system including:

a pilot-operated load sampling valve between said reversing valve and said compensator selection valve having a first position for preventing control pressure from communicating with said reversing valve and a second position for admitting control pressure to said reversing valve; and a pilot connection leading from each of said main fluid lines to opposite sides of said load sampling valve, said load sampling valve being normally held in its second position and being pilotable to its first position when the pressure in said one main fluid line is greater than the pressure in the other main fluid line by a predetermined amount.

5. The combination of claim 4, wherein:

the control circuit includes a motor displacement control means that is normally biased toward a minimum displacement position and hydraulically actuable toward a maximum displacement position through a load induced pressure line;

there is a bleed valve for the load induced pressure line; and actuation of the compensator selection valve and sequence valve results in a signal that passes through the load sampling valve when the load sampling valve is in its second position, said signal serving to actuate the bleed valve to bleed the load induced pressure line and allow the motor displacement control means to move to minimum displacement position.

6. In a hoist control for a marine crane having a bi-rotational variable displacement hydraulic winch motor, a reversible variable displacement hydraulic pump operably connected to the motor through opposite main fluid lines, and a control valve operably connected to the pump through a control circuit including control lines leading to opposite sides of the pump, the combination of:

selectively operable means to divert control pressure from the control valve and direct it through one of the control lines to cause the pump to deliver high pressure fluid to one of the main fluid lines;

a compensating valve connected between said one main fluid line and the other control line, said compensating valve being responsive to pressure in said one main fluid line and operable to admit said pressure to said other control line so that the pump develops only a predetermined pressure in said one main fluid line;

lock-out means to block communication between said one main fluid line and said compensating valve;

a normally closed lift selection valve in the control circuit and operable, only after control pressure is diverted from said control valve by said selectively operable means, to direct control pressure to stroke the motor to its maximum displacement position and to actuate said lock-out means;

speed sensing means for sensing the speed of the winch; and normally closed speed-responsive valve means between said lift selection valve and the motor being responsive to said speed sensing means and operable to pass control pressure from said lift selection valve to the motor only when the speed of the winch is less than a predetermined rate.

7. The combination of claim 6, wherein said lock-out means comprises:

a lock-out valve between said compensating valve and said one main fluid line having a normally open position in which it passes pressure from said one main fluid line to said compensating valve and operable in response to control pressure from said lift selection valve to prevent pressure in said one main fluid line from communicating with said compensating valve.

8. The combination of claim 7, further including an overload sensing system for sensing an overload including:

a normally closed kick-out valve between said one main fluid line and said lift selection valve, said kick-out valve being responsive to pressure in said one main fluid line that is indicative of an overload and operable to direct said pressure to shift said lift selection valve to its closed position and to shift said lock-out valve to its normally open position.

9. The combination of claim 6, wherein said speed sensing means includes:

a hydraulic circuit including means to provide fluid flow therein that is proportional to the speed of the winch;

flow control means in said hydraulic circuit for establishing a pressure differential indicative of the speed of the winch; and said speed-responsive valve means includes a pressure sensing valve having opposite pilot lines leading from opposite sides of said flow control means, said pressure sensing valve being normally held in a closed position and being pilotable to an open position when the pressure differential across said flow control means is less than a predetermined limit.

* * * * *